United States Patent [19]

Fauvarque et al.

[11] Patent Number: 4,517,061

[45] Date of Patent: May 14, 1985

[54] PROCESS FOR PREPARING ARYLACETIC AND ARYLPROPIONIC ACIDS

[75] Inventors: Jean-Francois Fauvarque; Anny Jutand, both of Paris; Claude Chevrot, Saint-Germain en Laye; Fernando Pfluger, Saint-Denis; Michel Troupel, Maincy, all of France

[73] Assignees: Compagnie General d'Electricite; Centre National de la Recherche Scientifique (CNRS), both of Paris, France

[21] Appl. No.: 513,497

[22] Filed: Jul. 13, 1983

[30] Foreign Application Priority Data

Jul. 13, 1982 [FR] France ..... 82 12275

[51] Int. Cl.[3] ..... C25B 1/00

[52] U.S. Cl. ..... 204/59 R

[58] Field of Search ..... 204/59 R

[56] References Cited

U.S. PATENT DOCUMENTS 3,344,045 9/1967 Neikam ..... 204/59 R 3,764,492 10/1973 Baizer ..... 204/59 R

OTHER PUBLICATIONS

Baizer et al., J. Org. Chem., vol. 37, No. 12, 1972, pp. 1951, 1957.

Troupel et al., *Nouveau Journal of Chimie,* vol. 5, No. 12 (1981) pp. 621–624.

*Primary Examiner*—John F. Niebling

*Attorney, Agent, or Firm*—Sughrue, Mion, Zinn, Macpeak and Seas

[57] ABSTRACT

The process includes an electrochemical reduction, under carbon dioxide atmosphere, of benzyl type $ArCH_2X$ or $ArCH(CH_3)X$ halogenides.

According to the invention, the process consists of operating in the presence of a catalyst containing at least one organometallic complex derived from a transition metal combined with a bidentate or tetradentate coordinate.

18 Claims, 1 Drawing Figure

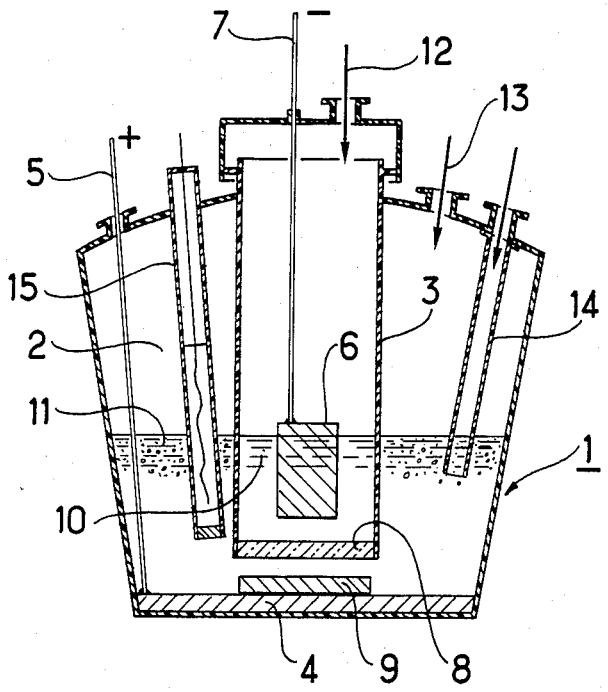
7
−
12
13
+
5
15
3
14
2
6
11
1
10
4
9
8

PROCESS FOR PREPARING ARYLACETIC AND ARYLPROPIONIC ACIDS

The invention relates to the preparation of arylacetic and arylpropionic acids from benzyl type halogenides with the formula $ArCH_2X$ and $ArCH(CH_3)x$, wherein Ar designates an aromatic group substituted or not and X designates a halogen.

The production of arylacetic and arylpropionic acids is of great importance as they form a main class of anti-inflammatories, anesthetics and they are also precursors in the preparation of penicillins.

They are known to be made from benzyl type halogenides by cyanuration, carbonation or carbonylation. However, these reactions are in most cases tricky, low in selectivity and provide unsatisfactory yield.

It is also known that it is possible to electrosynthesize aromatic carboxylic acids $ArCO_2H$ from aromatic halogenides and $CO_2$ under atmospheric pressure by using catalysts formed by organic nickel complexes.

Such a process has, for example, been described in the article published in the Nouveau Journal de Chimie, Vol. 5, No. 12-1981, pages 621 et seq., relative to the work carried out by Messrs. Troupel, Perichon and Fauvarque and Mrs. Rollin.

More precisely, triphenyl phosphine $P(C_6H_5)_3$ was used in this process to form the organic complexes.

However, it was observed that the process described above was not directly applicable to the case of benzyl halogenides as in this case only the formation of a bibenzyl compound was observed. Thus, should the process be applied to benzyl chloride $C_6H_5CH_2Cl$, only dibenzyl $C_6H_5—CH_2—CH_2—C_6H_5$ is obtained.

This invention enables this disadvantage to be remedied and arylacetic and arylpropionic acids to be easily produced by electrosynthesis.

Its object is a process for the preparation of arylacetic and arylpropionic acids, comprising an electrochemical reduction, under carbon dioxide atmosphere, of benzyl type halogenides with the formula $ArCH_2X$ or $ArCH(CH_3)X$, characterized by the fact that said reduction occurs in the presence of a catalyst comprising at least one organometallic complex derived from a transition metal combined with a bidentate or tetradentate coordinate.

A bidentate coordinate denotes a ligand having two coordination sites on the metal used. A tetradentate coordinate denotes a ligand having four coordination sites on the metal used.

The transition metal is selected such that it forms, with the above coordinates, an electroreducible organometallic complex which, in its reduced state, is capable of reacting with the benzyl type halogenide. The metal is preferably selected from the group comprising nickel and cobalt.

In accordance with the invention, the organometallic complex is selected from the group formed on the one hand by nickel bis cyclooctadiene and on the other hand by liganded metallic halogenides, with the formula $NiY_2L$, Y being a halogen, L the bipyridyl or a diphosphine type coordinate with the formula $PR_2—(CH_2)_n—PR_2$, in which P designates the phosphorus which is a coordination site, R being a radical selected from the group formed by the phenyl radical and the aliphatic radicals, n being an integer less than or equal to 4.

When R is the phenyl radical, n can be equal to 2, 3 or 4. When R designates the methyl radical, preferably n=2.

In accordance with one embodiment of the invention, the L coordinate is constituted by diphenyl phosphinoethane (DPPE) with the formula:

$$P(C_6H_5)_2—(CH_2)_2—P(C_6H_5)_2.$$

It is also possible to use diphenyl phosphinopropane (DPPP), with the formula $P(C_6H_5)_2—(CH_2)_3—P(C_6H_5)_3$ or dimethyl phosphinoethane (DMPE), with the formula $P(CH_3)_2—(CH_2)_2—P(CH_3)_2$.

In accordance with another embodiment of the invention, the catalyst consists of an M' salen complex where M' is nickel or cobalt, and where "salen" is the tetradentate coordinate bis(salicylidene)ethylene diamine, the catalyst having the formula:

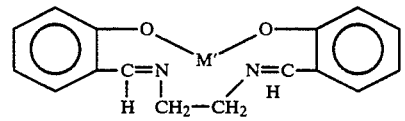

Preferably, the cobalt, which, with the "salen" coordinate, forms a more easily electroreducible complex than the corresponding nickel complex, should be used.

The orgamometallic catalysts conforming to the invention may be used alone or as part of a mixture.

It is also possible to add to them a cocatalyst consisting of a liganded metallic halogenide, with the formula $M_1Y_2L'_2$, L' being a coordinate with the formula $PR'_3$, R' being selected in the group formed by the alkyl and aryl radicals, $M_1$ being a transition metal, preferably nickel.

Thus, triphenyl phosphine (TPP), with the formula $P(C_6H_5)_3$, tributyl phosphine $P(C_4H_9)_3$, or tricyclohexyl phosphine $P(C_6H_{11})_3$ can be used as the second L' coordinate.

Preferably, the catalyst used has about four molar equivalents corresponding to the first $MY_2L$ complex for a molar equivalent corresponding to the second $M_1Y_2L'_2$ complex.

According to another characteristic of the invention, the catalyst comprises at least one organometallic complex of the above-mentioned type to which is added a monodentate or bidentate coordinate of the above-identified type, i.e., cyclooctadiene (COD) or bipyridyl.

Other characteristics of the invention will become apparent from the following description which relates to different examples of using the invention.

The single drawing represents very diagrammatically an electrolysis cell for using the invention.

The cell is designated by reference numeral 1. It consists of two separate compartments, a cathode compartment 2 and an anode compartment 3. The cathode 4 can be a felt, a fabric or a braid of carbon fibers or a sheet of mercury, with an area of about 20 $cm^2$. The cathode conductor consisting of a copper wire is designated by reference numeral 5.

The anode 6 can be of the alterable metal type, lithium, copper, etc., or of the unalterable type, carbon or metal, combined with an oxidizable electrolyte (for example, oxalate). The anode conductor, consisting of a copper wire, is designated by reference numeral 7.

With a view to electrochemical reduction, conductors 5 and 7 are connected to an appropriate generator.

Reference numeral 8 designates a fritted glass sheet separating the two compartments.

Reference numeral 9 designates a magnetized bar used for agitating the medium.

The electrolyte solvent is formed of a mixture containing, by volume, $\frac{2}{3}$ aprotic solvent, such as tetrahydrofuran (THF), and $\frac{1}{3}$ dipolar aprotic solvent, such as hexamethylphosphorotriamide (HMPT) or N-methyl pyrrolidone, or tetramethylurea.

The electrolyte can be identical or different in the anode 3 and cathode 2 compartments; it is used in a concentration of about 0.1 to 0.3 mole per liter. Thus, in anode compartment 3, the electrolyte 10 can be of the oxidizable type, preferably a sodium or lithium oxalate, or of the nonoxidizable type, combined with a soluble anode, for example lithium perchlorate ($LiClO_4$), or tetrabutylammonium tetrafluoborate ($(C_4H_9)_4NBF_4$).

In cathode compartment 2 a non-reducible electrolyte 11 ($LiClO_4$, tetrabutylammonium tetrafluoborate) is used into which the benzyl type halogenide and the catalyst conforming to the invention are introduced.

An electrode, reference numeral 15, consisting of a silver wire immersed in an aprotic solvent solution containing silver perchlorate in a concentration of 0.1 mole/liter, makes it possible to identify the potential of the cathode.

Arrows 12 and 13 symbolize the introduction, if necessary, of an inert gas in the anode 3 and cathode 2 compartments. Furthermore, carbon gas, at atmospheric or slightly higher pressure, may be introduced in the electrolytic cathode solution via tube 14.

In order to avoid secondary reactions, the residual water contained in the electrolytic medium is carefully eliminated.

This elimination can be carried out, for example by adding an organometallic halide, such as $C_2H_5MgX'$, X' being a halogen, for example, Br, in solution in ether or tetrahydrofuran.

To prepare the phenylacetic acid $C_6H_5CH_2CO_2H$, 5 millimoles of benzyl chloride $C_6H_5CH_2Cl$ are introduced in cathode compartment 2. The catalyst conforming to the invention is also added in a quantity such that one mole of benzyl chloride corresponds to 0.1 atom-gram of transition metal.

Then the carbon dioxide is made to bubble in the cathode compartment of the cell, at atmospheric or slightly higher pressure.

The reaction medium is maintained at room temperature or cooled by external circulation of cold water.

The electrochemical reduction is then completed at controlled potential.

Thus, the potential of the agitated sheet of mercury, in relation of the $Ag/AgClO_4$ system, is kept at approximately −2.6 V.

Electrochemical reduction is effected until the quantity of current passed corresponds to a predetermined value, or until the current is nil.

Current density at the start of the reduction is about 35 mA/cm$^2$.

The solution is then hydrolyzed in an acid medium and extracted with ether.

The etherized phase is agitated with aqueous sodium, then separated.

The vapor-phase chromatographic analysis of the etherized phase makes it possible to calculate the quantity of $C_6H_5CH_2Cl$ remaining, together with the quantity of $C_6H_5—CH_2—CH_2—C_6H_5$ formed.

The basic aqueous phase is acidified, NaCl saturated, then extracted with ether. The etherized phase is dried on $MgSO_4$, then evaporated.

In this manner, the phenylacetic acid formed is recovered, which is characterized by its I.R. and N.M.R. 1H spectra and by its melting point.

The principle of the method, described for the manufacture of phenylacetic acid from benzyl chloride, in the presence of a liganded nickel halogenide $NiY_2L$, is as follows:

In a first stage, an intermediate complex is formed electrochemically by insertion of the transition metal, e.g., nickel, within the C—Cl bond of the benzyl chloride.

In the first stage the reaction is:

$$NiY_2L + 2e^- \rightarrow Ni^\circ L + 2Y^-$$

This stage is not necessary if a zerovalent nickel complex such as $Ni(COD)_2$ is used, but such complexes, which are very oxidizable in air, are less convenient to handle.

The $Ni^\circ L$ complex is generally very reactive and not very stable. Its stability is increased by the presence of another bidentate coordinate in the medium selected so as to weakly complex $Ni^\circ L$, for example COD or bipyridyl, which are relatively low-value coordinates of the zerovalent nickel and which hardly impede its subsequent reaction with the benzyl chloride.

In a second stage, there is:

$$Ni^\circ L + C_6H_5CH_2Cl \rightarrow C_6H_5CH_2NiClL$$

The overall balance being:

$$NiY_2L + C_6H_5CH_2Cl + 2e^- \rightarrow C_6H_5CH_2NiClL + 2Y^-$$

This complex can be reduced electrochemically in accordance with:

$$C_6H_5CH_2NiClL + 2e^- \rightarrow C_6H_5CH_2NiL^- + Cl^-$$

This intermediate element can break down, giving off dibenzyl, $C_6H_5—CH_2—CH_2—C_6H_5$, but, in the presence of $CO_2$, phenylacetic acid with regeneration of the zerovalent nickel complex is obtained:

$$C_6H_5CH_2NiL^- + CO_2 \rightarrow C_6H_5CH_2COO^- + Ni^\circ L$$

The catalytic cycle can then continue. Globally the reaction is:

$$C_6H_5CH_2Cl + CO_2 + 2e^- \xrightarrow[10\%]{NiY_2L} C_6H_5CH_2COO^- + Cl^-$$

The reactions are the same with other organometallic complexes conforming to the invention.

Several examples of preparation have been carried out from $C_6H_5CH_2Cl$ by modifying the nature of the catalytic species and the temperature of the medium.

For these examples, the T1 percentage of $C_6H_5CH_2Cl$ consumed in relation to the initial quantity, the RC percentage (chemical yield) of $C_6H_5CH_2COOH$ formed in relation to the quantity of $C_6H_5CH_2Cl$ consumed, the T3 percentage of $C_6H_5—CH_2—CH_2—C_6H_5$ formed in relation to the initial quantity of $C_6H_5CH_2Cl$, and the faradic yield RF, representing the quantity of acid formed related to the quantity of electricity consumed given the stoechiometric equation, were measured.

In all these examples the reaction medium contained 0.1 atom-gram of nickel to 1 mole of $C_6H_5CH_2Cl$, the $CO_2$ pressure was 1 atmosphere and the potential was maintained at −2.6 V, unless otherwise specified; the electrolyte solvent consisted of THF/HMPT ($\frac{2}{3}$ to $\frac{1}{3}$ ratio) in Examples 1 to 12, ($\frac{1}{2}$, $\frac{1}{2}$ ratio) in Examples 13 and 14; in Examples 1 to 9 the electrolyte was $LiClO_4$ 0.1M; in Examples 10 to 12, the cathode electrolyte was tetrabutylammonium tetrafluoborate 0.3M, the anode electrolyte being lithium oxalate 0.1M, with a carbon anode; in Examples 13 and 14 the electrolyte was $LiClO_4$ 0.2M.

EXAMPLE 1

Catalytic species
$NiCl_2$, DPPE and $NiCl_2$, $(TPP)_2$ in a molar ratio of 4/1.
Temperature 20° C.
Electrolysis discontinued at zero current.

EXAMPLE 2

Catalytic species
$NiCl_2$ DPPE and $NiCl_2$ $(TPP)_2$ in a molar ratio of 4/1.
Temperature 0° C.
Electrolysis discontinued after 8 hours.
It was observed that at 0° electrolysis was much slower than at 20° C.

EXAMPLE 3

Catalytic species
$NiCl_2$ DPPE and $NiCl_2$ $(TPP)_2$ in a molar ratio of 19/1.
Temperature 20° C.
Electrolysis discontinued after 8 hours.

EXAMPLE 4

Catalytic species
$NiCl_2$ DPPE and $NiCl_2$ $(TPP)_2$ in a molar ratio of 19/1.
Temperature 0° C.
Electrolysis discontinued after 15 hours.

EXAMPLE 5

Catalytic species
$NiCl_2$, DMPE and $NiCl_2$ $(TPP)_2$ in a molar ratio of 4/1.
Temperature 20° C.
Electrolysis discontinued when current became too weak.

EXAMPLE 6

Catalytic species
$NiCl_2$, DMPE and $NiCl_2$ $(TPP)_2$ in a molar ratio of 19/1.
Same conditions as Example 5.

EXAMPLE 7

Catalytic species
$NiCl_2$, DPPP and $NiCl_2$ $(TPP)_2$ in a molar ratio of 4/1.
Same conditions as Example 5.

EXAMPLE 8

Catalytic species
$NiCl_2$, DPPE and $NiCl_2$, $[P(C_6H_{11})_3]_2$ in a molar ratio of 4/1.
Same conditions as Example 5.

EXAMPLE 9

Catalytic species
$NiCl_2$, DPPE
Same conditions as Example 5.

EXAMPLE 10

Catalytic species
$NiCl_2$, DPPP+COD in a molar proportion of 1/1.
Temperature 20° C.
Electrolysis completed within 5 hours.

EXAMPLE 11

Catalytic species
Nickel bis cyclooctadiene.
Temperature 20° C.
Electrolysis discontinued after 20 hours.

EXAMPLE 12

Catalytic species
$NiCl_2$, bipyridyl
Temperature 20° C.
Electrolysis for 25 hours.

EXAMPLE 13

Catalytic species
Cobalt salen
$CO_2$ under atmospheric pressure.
Electrolysis at −2.3 V on mercury cathode at the reduction potential of Co salen; total conversion in 20 hours.

EXAMPLE 14

Same conditions as for Example 13 but under two $CO_2$ atmospheres.

The results of the measurements are explained in the following table:

| Examples | Temperature | T1 | R | RC | RF | T3 |
|---|---|---|---|---|---|---|
| 1 | 20 | 87 | 51 | 59 | — | 18 |
| 2 | 0 | 25 | 23 | 92 | 92 | traces |
| 3 | 20 | 50 | 42 | 84 | 84 | 8 |
| 4 | 0 | 55 | 42 | 76 | — | 3 |
| 5 | 20 | 60 | 37 | 60 | — | 8 |
| 6 | 20 | 49 | 29 | 59 | — | 7 |
| 7 | 20 | 55 | 42 | 76 | — | 13 |
| 8 | 20 | 40 | 19 | 47 | — | 21 |
| 9 | 20 | 60 | 26 | 43 | — | 34 |
| 10 | 20 | 97 | 50 | — | — | — |
| 11 | 20 | 65 | 40 | 60 | — | — |
| 12 | 20 | 90 | 30 | — | — | — |
| 13 | 20 | 100 | 63 | — | — | — |
| 14 | 20 | 100 | 80 | — | — | — |

It will have been observed that it was desirable to carry out the electrochemical reduction in one stage.

In effect, if two stages are carried out, a first stage corresponding to the formation of the intermediate complex $C_6H_5CH_2NiClL$, said operation taking place under a neutral gas, and the second corresponding to the reduction of this complex in the presence of $CO_2$, the biaryl derivative is preferentially formed.

Thus, if the conditions of Example 1 are used, executing a first electrochemical reduction under argon, at a potential of −2.1 V, followed by a second reduction in the presence of $CO_2$ at a potential of −2.6 V, the value obtained for T3 passes from 18 to 48.

Examples were also carried out corresponding to the preparation of arylpropionic acids.

In this manner, the synthesis of phenyl propionic acid $C_6H_5CH(CH_3)COOH$ from $C_6H_5CH(CH_3)Cl$ was carried out.

Due to the structure of this compound, there is an additional undesired reaction, which, by elimination of HCl, leads to the formation of styrene. To avoid this reaction, it is preferable, on the one hand, to conduct the operation at a temperature below room temperature, for example at 0° C., and on the other hand, when the catalyst is $NiY_2L$, to add one additional bidentate, COD or bipyridyl for example, which weakly coordinates with zerovalent nickel.

Using Co salen as the catalyst does not require an additional coordinate.

Several examples of preparation were produced from $C_6H_5$—$CH(CH_3)Cl$.

In all these examples the T'1 percentage of $C_6H_5$—$CH(CH_3)Cl$ consumed in relation to the initial quantity, the chemical yield RC' and the faradic yield RF' were measured. The byproduct was styrene. This gave the global reaction:

$$C_6H_5CH(CH_3)Cl+CO_2+2e^-\rightarrow C_6H_5—CH(CH_3)CO_2^-+Cl^-.$$

In Examples 15 to 20, the reaction medium contained 0.1 atom-gram of nickel to 1 mole of $C_6H_5CH(CH_3)Cl$, the $CO_2$ pressure was 1 atmosphere, the temperature 0° C., and the potential was maintained at about −2.4, −2.6 V in relation to the reference electrode Ag+/Ag. In Example 21, the catalytic species was Co salen.

In Examples 15 to 20 the cathode electrolyte was tetrabutylammonium tetrafluoborate 0.3M, in Example 21, $LiCO_4$ 0.2M. The electrolyte solvent was THF-HMPT (ratio $\frac{2}{3}$, $\frac{1}{3}$).

EXAMPLE 15

Catalytic species
$NiCl_2$, DPPP
Copper anode.
Electrolysis until zero current.
T1': 40, RC': 57, RF': 73.

EXAMPLE 16

Catalytic species
$NiCl_2$, DPPE+COD, DPPE and COD in a 1/1 molar ratio.
Copper anode.
Electrolysis in 20 hours.
T1': 72, RC': 82, RF': 74.

EXAMPLE 17

Catalytic species
$NiCl_2$, DPPP+COD, DPPP and COD in a 1/1 molar ratio.
Copper anode.
Electrolysis discontinued at 55% of the theroretical quantity of electricity.
RC': 71, RF': 94.

EXAMPLE 18

Catalytic species
$NiCl_2$, DPPP+bipyridyl, DPPP and bipyridyl in a 1/1 molar ratio.
Copper anode.
T1': 82, RC': 51, RF': 44.

EXAMPLE 19

Catalytic species
$NiCl_2$, DPPP+COD, DPPP and COD in a 1/1 molar ratio.
Platinum anode.
Anode electrolyte 0.1M sodium oxalate.
T1': 100, RC': 75, RF': 75.

EXAMPLE 20

Catalytic species
$NiCl_2$, DPPP+COD, DPPP and COD in a molar ratio of 1/1.
Cathode in braided carbon fibers and no longer mercury.
Platinum anode, anode electrolyte: lithium oxalate.
Complete electrolysis in 12 hours.
T1': 96, RC': 89, RF': 93.

EXAMPLE 21

Catalytic species
Co salen.
$CO_2$ under 1 atmosphere.
Electrolysis at −2 volts at 20° C.
T1': 100, RC': 60.

The above-described process may thus be directly applied to the synthesis of a commercial anti-flammatory substance, naproxene, in accordance with the reaction:

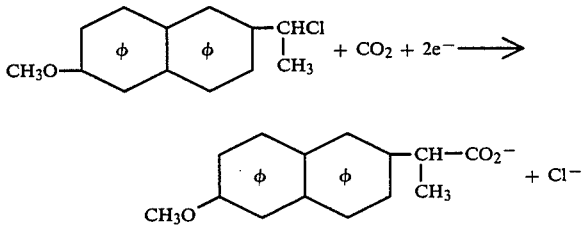

catalytic species: $NiCl_2$, DPPP+COD, DPPP and COD in a molar ratio of 1/1 at 0° C.

T1': 100, RC': 66, RF': 66.

The invention, of course, is in no way limited to the methods of execution which have been given only as examples.

We claim:

1. A process for preparing arylacetic and arylpropionic acids, including an electrochemical reduction, under carbon dioxide atmosphere at or close to atmospheric pressure, of benzyl type halogenides with the formula $ArCH_2X$ or, $ArCH(CH_3)X$ characterized by the fact that said reduction is effected in the presence of a catalyst comprising at least one organometallic complex comprising a transition metal complexed with a bidentate or tetradentate coordinate.

2. The process according to claim 1, characterized by the fact that the transition metal is selected from the group comprising nickel and cobalt.

3. The process according to claim 2, characterized by the fact that the organometallic complex is selected from the group formed, on the one hand, by nickel bis cyclooctadiene and, on the other hand, by liganded metallic halogenides, with the formula $NiY_2L$, Y being a halogen, L the bipyridyl or a coordinate of the diphosphine type, with the formula $PR_2$—$(CH_2)_n$—$PR_2$ wherein P designates phosphorus, R being a radical selected from the group formed by the phenyl radical and the aliphatic radicals, n being an integer less than or equal to 4.

4. The process according to claim 3, characterized by the fact that R is the phenyl radical and n=2, 3 or 4.

5. The process according to claim 3, characterized by the fact that R is the methyl radical and n=2.

6. The process according to claim 2, characterized by the fact that the catalyt is an M' salen complex where M' represents nickel or cobalt and salen the bis(-salicylidene)ethylene diamine tetradentate coordinate.

7. The process according to one of claims 1 to 6, characterized by the fact that the catalyst also comprises a cocatalyst consisting of a liganded metallic halogenide, with the formula $M_1Y_2L'_2$, L' being a coordinate of the formula $PR'_3$, R' being selected from the group formed by the alkyl and aryl radicals, $M_1$ being a transition metal.

8. The process according to claim 7, characterized by the fact that the catalyst contains approximately four molar equivalents of organometellic complex for a molar equivalent of $M_1Y_2L'_2$.

9. The process according to one of claims 1 to 6, characterized by the fact that, in addition to the organometallic complex, the catalyst contains a monodentate or bidentate coordinate.

10. The process according to claim 9, characterized by the fact that said coordinate is selected from the group formed by cyclooctadiene and bipyridyl.

11. The process according to claim 9, characterized by the fact that the organometallic complex and said coordinate are in a molar ratio of 1/1.

12. The process according to claim 2, characterized by the fact that the reaction mixture contains 0.1 atomgram of nickel or cobalt for every benzyl molecule.

13. The process according to claim 1, characterized by the fact that the reaction medium is maintained at or below room temperature during the preparation process.

14. The process according to claim 1, characterized by the fact that the electrochemical reduction is effected in an anhydrous electrolytic medium.

15. The process according to claim 1, characterized by the fact that the electrochemical reduction is carried out in an electrolysis cell containing a cathode compartment and an anode compartment, the cathode consisting of a felt, a carbon fabric or braid, or a sheet of mercury, the anode consisting of an alternable metal, such as lithium or copper, or of an unalterable material, the electrolyte containing a solvent comprising a mixture of an aprotic solvent, such as tetrahydrofuran, and one dipolar aprotic solvent, such as hexamethylphosphorotriamide, N-methylpyrrolidone or tetramethylurea.

16. The process according to claim 15, characterized by the fact that when the anode consists of an unalterable metal, the electrolyte present in the anode compartment consists of an oxalate such as a sodium or lithium oxalate.

17. The process according to claim 14, characterized by the fact that when the anode consists of an alterable metal, the electrolyte present in the anode compartment contains lithium perchlorate or tetrabutylammonium tetrafluoborate.

18. The process according to claim 15, characterized by the fact that the electrolyte present in the cathode compartment contains lithium perchlorate or tetrabutylammonium tetrafluoborate.

* * * * *